US005125870A

United States Patent [19]

Kilian

[11] Patent Number: 5,125,870

[45] Date of Patent: Jun. 30, 1992

[54] FLUE INSULATION ASSEMBLY

[75] Inventor: Günter Kilian, Mannheim-Feudenheim, Fed. Rep. of Germany

[73] Assignee: G+H Montage GmbH, Fed. Rep. of Germany

[21] Appl. No.: 628,110

[22] Filed: Dec. 17, 1990

[30] Foreign Application Priority Data

Dec. 18, 1989 [DE] Fed. Rep. of Germany ..... 3941779

[51] Int. Cl.[5] ..... E04B 1/76

[52] U.S. Cl. ..... 454/47; 110/184

[58] Field of Search ..... 98/60, 58, 59; 52/218; 110/184

[56] References Cited

U.S. PATENT DOCUMENTS

| | | | |
|---|---|---|---|
| 795,332 | 7/1904 | Broome | 52/218 |
| 1,047,553 | 12/1912 | Newell | 110/184 |
| 1,358,412 | 11/1920 | Breidert | 98/60 |
| 2,435,172 | 1/1948 | Young | 52/218 |
| 3,604,376 | 9/1971 | Meyer | 98/60 |
| 3,872,780 | 3/1975 | Zanias | 98/60 |
| 4,519,303 | 5/1985 | Snook | 98/58 |
| 4,567,700 | 2/1986 | Snook | 98/58 |

FOREIGN PATENT DOCUMENTS

| | | | |
|---|---|---|---|
| 1815516 | 6/1970 | Fed. Rep. of Germany | 52/218 |
| 8301318 | 11/1984 | Netherlands | 52/218 |

*Primary Examiner*—Albert J. Makay
*Assistant Examiner*—William C. Doerrler
*Attorney, Agent, or Firm*—Finnegan, Henderson, Farabow, Garrett & Dunner

[57] ABSTRACT

A flue insulation assembly comprising an insulation lining surrounding the flue wall in spaced relationship and composed of insulation elements retained by a mounting structure. The insulation lining is composed of a plurality of plate-shaped insulation elements laterally abutting one another so as to form a near-annular polygon, and the mounting structure is composed of vertically spaced mounting rings connected to the flue wall by mounting ring supports and adapted to retain the insulation elements therebetween. The mounting rings are provided with stop elements projecting over the upper and lower rims of the plate-shaped insulation elements on both sides thereof, and an outer skin is secured to the mounting rings.

19 Claims, 1 Drawing Sheet

FLUE INSULATION ASSEMBLY

BACKGROUND OF THE INVENTION

The invention relates to a flue insulation assembly comprising an insulation lining formed of insulating elements supported by a mounting structure and surrounding the flue wall in spaced relationship thereto.

Internally ventilated flue insulation assemblies of this type are employed for instance as sound and heat insulation systems for exhaust gas flues of gas turbines, the flue wall being cooled by the internal ventilation. This cooling results in a reduction of the demands regarding the characteristics of the material employed for making the flue wall, which may thus be made of for instance normal boiler plate material rather than of expensive stainless steel.

A flue insulation system of the above noted type for heat and sound insulation is known from DE 33 55 964 C2. The insulation lining surrounding the flue is composed of curved insulation elements of crenellated cross-sectional shape, which are suspended from mounting supports connected to the flue wall. The crenellated configuration of the insulation elements results in the formation of vertically and horizontally extending abutment joints of a cross-sectional zig-zag pattern.

It is an object of the present invention to provide an alternative solution for the construction of a flue insulation system of the type defined in the introduction.

SUMMARY OF THE INVENTION

This object is attained according to the invention by the provision that the mounting structure comprises vertically spaced mounting rings for carrying the insulation elements and supported on the flue wall by respective mounting ring supports, that annular groups of laterally abutting plate-shaped insulation elements are disposed between vertically adjacent mounting rings, that the mounting rings are provided with stop elements projecting over the upper and lower rims of the insulation elements on both sides thereof, and that an outer skin is secured to the mounting rings.

This structural solution according to the invention thus uses planar plate-shaped insulation elements, the production of which is substantially less expensive than that of curved insulation elements, as a result of which an internally ventilated flue insulation system can be installed at lower costs than formerly thought possible.

In an advantageous embodiment of the invention the mounting rings are of I-shaped cross-sectional configuration. In this case the plate-shaped insulation elements have their lower edge supported on the central web portion of the mounting ring, and the stop elements are formed by the lateral flange portions of the mounting ring. According to another advantageous aspect of the invention, each mounting ring support may comprise a carrier element connected to the flue wall, and a spacer element connected to the mounting ring and supported on the carrier element. In this case the carrier element may be designed in a structurally simple manner as a rectangular plate connected to the flue wall along one of its longitudinal edges and having its transverse rim received in a recess formed in the associated spacer element. The movable support of the spacer element on the carrier element permits different heat expansion rates of the flue wall and the insulation lining to be accommodated.

BRIEF DESCRIPTION OF THE DRAWINGS

Embodiments of the invention shall now be described and explained in detail by way of example with reference to the accompanying drawings, wherein.

DETAILED DESCRIPTION OF THE INVENTION

Figure 1:
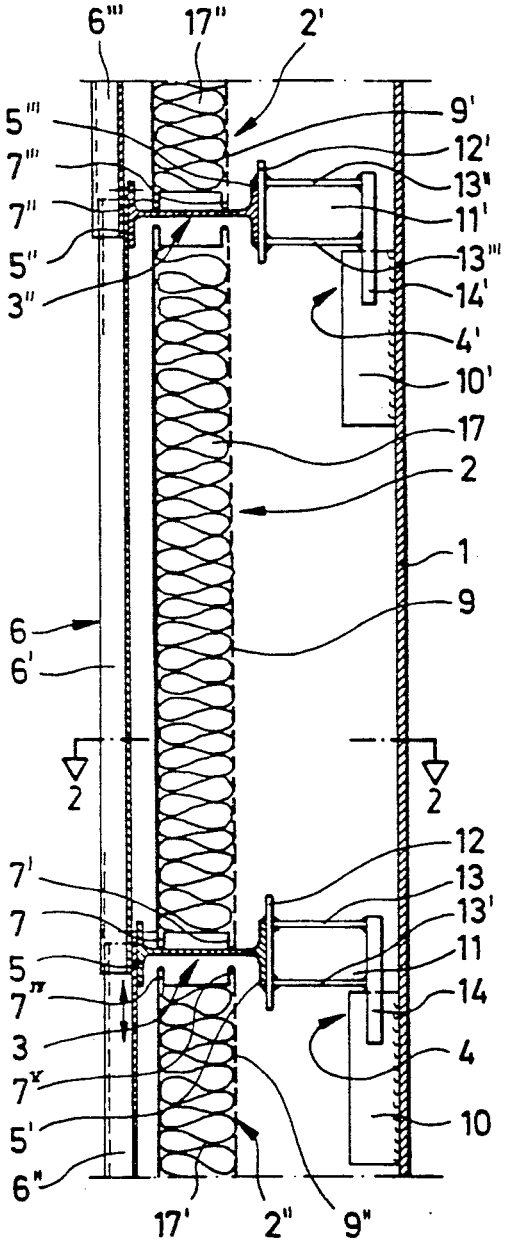
FIG. 1 shows a vertically sectioned view of a flue insulation assembly according to the invention.
Figure 2:
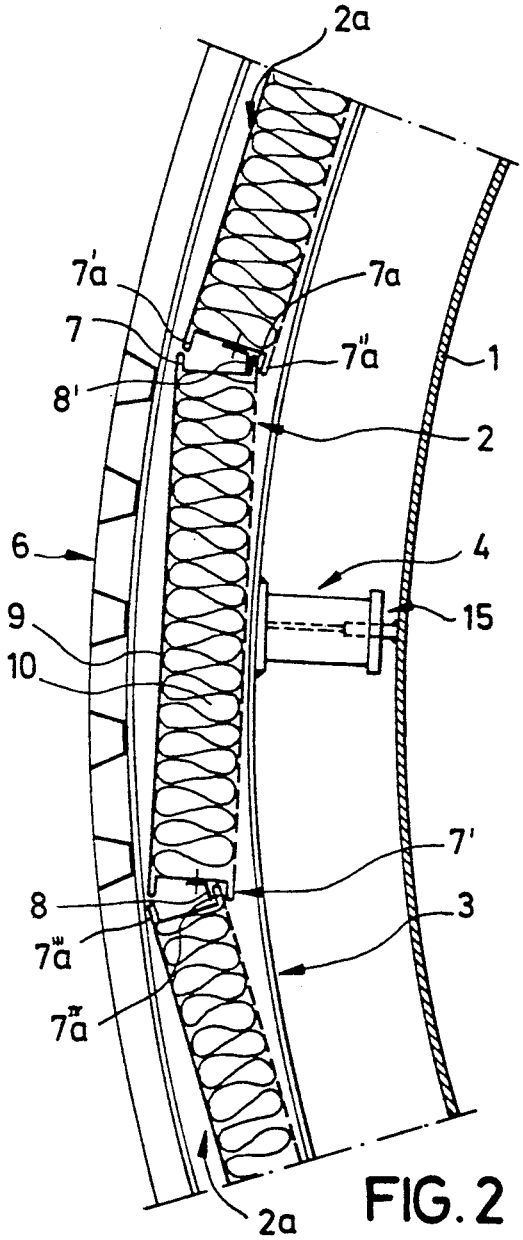
FIG. 2 shows a horizontally sectioned view of the flue insulation assembly of FIG. 1, taken along the line A—A in this figure.

Designated by reference numeral 1 in FIGS. 1 and 2 is a portion of a flue wall consisting of a steel sheet. Secured to flue wall 1 at predetermined vertical and circumferential spacings are several carrier elements, two such carrier elements being indicated at 10 and 10' in FIG. 1. In the illustrated embodiment, carrier elements 10 are formed as rectangular steel plates welded to flue wall 1. Indicated at 2, 2' and 2'' in FIG. 1 are plate-shaped insulation elements having their lower edges supported on mounting rings 3 and 3'', respectively, as shown in FIG. 1. The mounting rings extend around the flue and are of I-shaped cross-sectional configuration, their vertically extending flange portions 5 to 5''' on the inner and outer rim portions thereof forming a recess between them on the upper and lower sides of the rings and acting as lateral stop elements for the insulation elements. The upper edge portions of the insulation elements are received between the downwards projecting flange portions, with an expansion joint being provided between the upper edge of the insulation elements and the web portion of the associated mounting ring. In accordance with the invention, means are provided for securing the rings to the flue wall in spaced relationship thereto and vertically spaced from one another. As embodied, this means comprises spacer elements disposed at spaced locations around the flue, two such spacer elements being indicated at 11 and 11' in FIG. 1. In the present embodiment, each spacer element comprises a base plate 12 or 12', respectively, and a support plate 14 or 14', respectively, connected to base plate 12 or 12', respectively by two parallel spaced cross plates 13 and 13' or 13'' and 13''', respectively. In the present embodiment, the base plate is welded to the associated mounting ring, and the cross plates are welded to the base plate and the support plate. The rim of the support plate 14 or 14', respectively, by which the spacer element is supported on the associated carrier element, is formed with a recess 15 in the form of a slot in which the respective carrier element is received. The spacer element 11 or 11', respectively, and the associated carrier element 10 or 10', respectively, together constitute a mounting ring support indicated at 4 or 4', respectively, in FIG. 1.

Secured to the side of the mounting rings facing away from the flue wall is an outer skin 6 composed of corrugated sheet metal panels as indicated at 6', 6'' and 6''' in FIG. 1. The sheet metal panels are connected along their lower rims to the outer flange portion of one of the mounting rings, preferably by the use of countersunk screws. The upper rim of each sheet metal panel is retained in a sliding seat defined between the lower rim of the sheet metal panel disposed above it and the outer flange portion of the associated mounting ring. The corrugations of the sheet metal panels may be of angular or round shape, the employ of flat sheet metal panels being also possible.

In the present embodiments, the plate-shaped insulation elements are steel sheet casing containing a mineral wool filing. The mineral wool fillings of insulation elements 2, 2' and 2'' are designated at 17, 17' and 17'', respectively, in FIG. 1. The wall 9, 9' and 9'' of the sheet metal casings facing towards the flue wall are provided in the present example with a perforation pattern, while the outwards facing casing walls are solid sheet metal. Along their circumferential edges, the sheet metal casings are formed with projecting web or fold portions 7 to 7'''' or 7*a* to 7IV*a'''*, respectively, as indicated in FIGS. 1 and 2, formed by folding the rims of the main walls over the outwards bent rims of the circumferential walls of the sheet metal casings.

As evident from FIG. 2, the abutment joins between adjacent plate-shaped insulation elements are configured so that the projecting fold portions on the sides of the insulation elements facing towards the flue wall overlap one another, and that expansion joints are provided between laterally adjacent insulation elements. Indicated at 8 or 8', respectively, in FIG. 2 is a vertically extending, and in the present example obliquely projecting sealing lip secured to one of the two vertical end faces of each insulation element, the abutment joint between the adjacent insulation elements being configured so that a projecting fold portion 7 of one of the insulation elements is received between the sealing lip 8 and the respective projecting fold portion 7 of the other insulation element. FIG. 2 shows projecting fold portion 7IV*a* received between sealing lip 8 and projecting fold portion 7' and projecting portion 7*a* between sealing lip 8' and projecting fold portion 7''*a*, respectively. This configuration of the abutment joints between adjacent insulation elements results in the formation of a labyrinth seal therebetween.

The series of insulation elements retained between two adjacent mounting rings forms a substantially annular polygon. Their retention between the mounting rings does not require any additional fastening means. Expansion joints are provided both between the adjacent insulation elements and between the individual insulation elements and the lateral flange portions of the mounting rings, so that any heat expansion is readily accommodated. The lack of any rigid connection at the point of contact between the spacer elements and the carrier elements permits any heat expansion to be accommodated, specifically in view of the fact that the flue is exposed to higher temperatures than the insulation lining. Since the heating of the flue causes the latter to expand also in its longitudinal direction, as a result of which the spacing of the mounting rings increases, the outer skin panels are mounted so as to overlap one another with a sliding seat formed therebetween and effective to accommodate longitudinal displacements. The labyrinth seals between laterally adjacent insulation elements ensures effective heat insulation also at the abutment joints. The outer skin acts as a weather protection and is particularly effective to prevent the loosely retained insulation elements between the mounting rings from vibrating under the influence of winds.

Figure 3:
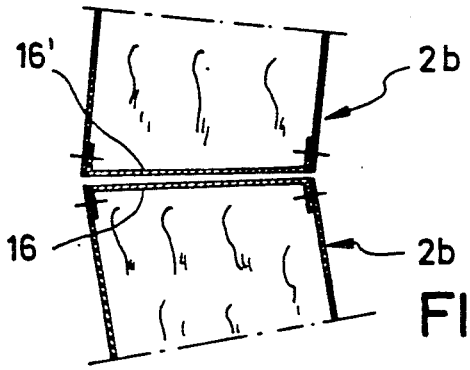
FIG. 3 shows by way of example the construction of the abutment portions of two adjacent insulation elements of a flue insulation assembly according to the invention.

FIG. 3 illustrates another possibility of designing the abutment joints between laterally adjacent heat insulation plate elements. In this embodiment, the end wall faces 16 and 16' of adjacent insulation elements 2*b* and 2*b* are angularly inclined relative to the parallel main wall surfaces thereof, so that the insulation elements have a trapezoidal cross-sectional shape permitting the formation between adjacent insulation elements of a long expansion slot acting as a slit seal. In the present embodiment the end walls are made of sheet metal and provided with a perforation pattern. The provision of perforations in the casing walls permits a gas exchange flow to take place between the insulation material and the ambient atmosphere.

I claim:

1. A flue insulation assembly for surrounding and mounting to a flue wall in spaced relationship thereto, said assembly comprising a plurality of mounting rings adapted to annularly surround the flue wall and having an inner and outer rim portion, means for securing the rings to the flue wall in spaced relationship thereto and vertically spaced from one another, stop elements on the upper and lower sides of the inner and outer rim portions of the rings forming a recess between them on said upper and lower sides of the rings, annular groups of a plurality of laterally abutting, plate-shaped insulation elements disposed in said recesses between vertically adjacent mounting rings forming a ring around said flue wall and an outer skin secured to the outer rim portions of said mounting rings.

2. The flue insulation assembly of claim 1, wherein the upper edges of the insulation elements are spaced from the lower sides of the adjacent mounting ring to provide a thermal expansion joint therebetween.

3. The flue insulation assembly of claim 1, wherein the laterally abutting edges of said plate-shaped insulation elements have vertically extending projecting web portions that overlap one another in the vertical direction.

4. The flue insulation assembly of claim 3, wherein the projecting vertical web portion of one insulation element is located between a vertical web portion of an adjacent insulation element and a sealing lip projecting from said adjacent insulation element to form a labyrinth seal.

5. The flue insulation assembly of clam 1, wherein the plate-shaped insulation elements are of trapezoidal cross-sectional shape so as to form a slit seal between the laterally abutting edges thereof.

6. The flue insulation assembly of claim 1, wherein plate-shaped insulation elements comprise spaced sheet metal walls filled with an insulation material between them.

7. The flue insulation assembly of claim 6, wherein the sheet metal walls of said elements facing towards said flue wall are perforated.

8. The flue insulation assembly of claim 6, wherein sheet metal walls forming the laterally abutting edges of said insulation elements are perforated.

9. The flue insulation assembly of claim 6, wherein the laterally abutting edges of said plate-shaped insulation elements have vertically extending projecting web portions that overlap one another in the vertical direction, said web portions being formed by folding over the outer edges of said sheet metal walls.

10. The flue insulation assembly of claim 1, wherein said mounting rings are of I-shaped cross-sectional configuration.

11. The flue insulation assembly of claim 1, wherein the means for securing the rings to the flue wall comprise a plurality of carrier elements mounted on the flue wall and spacer elements supported on a carrier element and connected to a mounting ring.

12. The flue insulation assembly of claim 11, wherein said spacer elements comprise a base plate connected to a mounting ring and a support plate spaced from and connected to the base plate by at least one cross beam element, said support plate adapted to rest on a carrier element.

13. The flue insulation assembly of claim 12, wherein said base plate is connected to said support plate by two laterally spaced cross beam elements.

14. The flue insulation assembly of claim 12, wherein said carrier elements are received in a recess formed in said support plates.

15. The flue insulation assembly of claim 11, wherein said carrier elements are rectangular plates connected to said flue wall along one of their longitudinal sides.

16. The flue insulation assembly of claim 1, wherein said outer skin is formed of corrugated or flat sheet metal panels.

17. The flue insulation assembly of claim 16, wherein said sheet metal panels are connected to a mounting ring at least along their lower edges.

18. The flue insulation assembly of claim 17, wherein the lower rims of said sheet metal panels cooperate with the respective mounting ring to define a sliding seat for the upper rim of an adjacent sheet metal panel.

19. The flue insulation assembly of claim 1, wherein the plate-shaped insulation elements are spaced from said stop elements of said recesses to provide a thermal expansion joint therebetween.

* * * * *